US006554675B1

(12) United States Patent
Nyengaard

(10) Patent No.: US 6,554,675 B1
(45) Date of Patent: Apr. 29, 2003

(54) METHOD OF PACKAGING TOY BUILDING ELEMENTS AND PACKAGING FOR EXERCISING THE METHOD

(75) Inventor: Lars Randel Nyengaard, Billund (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/381,756

(22) PCT Filed: Mar. 25, 1998

(86) PCT No.: PCT/DK98/00123

§ 371 (c)(1),
(2), (4) Date: Jan. 12, 2000

(87) PCT Pub. No.: WO98/42422

PCT Pub. Date: Oct. 1, 1998

(30) Foreign Application Priority Data

Mar. 26, 1997 (DK) ..... 0350/97

(51) Int. Cl.[7] ..... A63H 33/04

(52) U.S. Cl. ..... 446/85; 446/75; 446/128; 446/94

(58) Field of Search ..... 446/85, 75, 128, 446/94, 87, 88, 93, 117, 118, 124, 125; 273/157 R

(56) References Cited

U.S. PATENT DOCUMENTS

| | | | | | |
|---|---|---|---|---|---|
| 1,902,136 | A | * | 3/1933 | Mills | 446/124 |
| 3,473,257 | A | * | 10/1969 | Gambino | 446/94 |
| 4,861,305 | A | * | 8/1989 | Wilson | 446/75 |
| 4,874,176 | A | * | 10/1989 | Auerbach | 446/124 |
| 4,946,414 | A | * | 8/1990 | Zimmer | 446/71 |
| 5,096,424 | A | * | 3/1992 | Carlberg | 446/302 |
| 5,643,038 | A | | 7/1997 | Olsen et al. | |
| 5,716,211 | A | * | 2/1998 | Vetter | 446/8 |
| 5,984,755 | A | * | 11/1999 | Avey | 446/75 |

FOREIGN PATENT DOCUMENTS

| | | |
|---|---|---|
| DE | 28 26 123 | 12/1979 |
| GB | 2010102 A | 6/1979 |
| WO | WO 92/06015 | 4/1992 |

OTHER PUBLICATIONS

Lego catalog, 1978.*
Meccano Erector set catalog including basic sets#1, #2, Nov. 1993.*
Lego expert builder sets catalog, 1982.*
Lego® catalog (1974).*

* cited by examiner

*Primary Examiner*—Derris H. Banks
*Assistant Examiner*—Urszula M Cegielnik
(74) *Attorney, Agent, or Firm*—Pitney, Hardin, Kipp & Szuch LLP

(57) ABSTRACT

A method of packaging the toy building elements for a set for building a toy model in which the model is separated into definable sections. The elements for each section, including elements for interconnection to other sections are separately packaged, along with instructions for assembling the separate sections. Instructions are further provided for interconnecting the sections to form the desired model.

7 Claims, 10 Drawing Sheets

Bag 4

METHOD OF PACKAGING TOY BUILDING ELEMENTS AND PACKAGING FOR EXERCISING THE METHOD

BACKGROUND OF THE INVENTION

The invention relates to a method of packaging toy building elements for toy building sets for the construction of a toy model comprising a number of associated model sections.

Usually, the building elements in a toy building set are packed in a number of bags, where selection of the contents of each bag is based on the criterion that the packaging machines should perform most efficiently, usually in connection with a subsequent control weighing. When a child is to construct a model by means of the building set, all the bags are opened and their contents discharged onto a support, following which relatively much of the time spent on building the model is consumed in finding the right elements to be used in accordance with the construction manual. Of course, this 'unproductive' work increases with increasing size of the relevant finished model.

SUMMARY OF THE INVENTION

It is the object of the invention to provide a novel method of packaging the toy building elements for a toy building set, by which it is substantially more expedient and easy to obtain an overall view of the many elements when the child sets out to build a toy model.

This object is obtained in that the elements are divided into a number of sets corresponding to each their model section; and that the sets are kept apart by means of the packaging, e.g. in the form of the bag or boxes.

In accordance with the invention, a model can typically be divided into 5–10 portions or sections, and the construction manual indicates which portion is to be built first, and so on. The fact that the individual elements that belong to each their section of the model are packed separately, makes it much more expedient and easier for the child to take in the many elements of which the model is composed. Not only will the child experience that time is saved, but the method according to the invention has shown that the child finds the building work less over-whelming, and thus it has been found that the targeted age for a given model can be lowered. It is a positive experience for the child to be able to build a more complex model than it would usually be able to, in particular as a consequence of the substantially reduced time of concentration which means that the invention increases the pedagogical value of the building set.

It is to be noted that, although the so-called 'combined-packaging' methods are known where the building elements for e.g. four mutually independent models are packed into each their compartment in a box, it will be understood from the above explanation that the method of the present invention is not in any way related to combined-packaging.

A model section may constitute a separate model portion whereby the child can obtain the finished model by interconnecting the model portions, but it is also an option that a model portion consists of a plurality of model sections that may, in accordance with the invention, be packed in each their bag, box or the like.

The model sections and the model portions may be classified in accordance with various criteria. For instance, a visual effect can be relatively more significant to small children whereas a distinction in accordance with the technical effect obtained is typically more significant to older children. Finally, the complexity of the model section can also play a part, in particular for the smaller children.

The construction manual may be subdivided, one manual for each model section, supplemented with a guide how to combine the model sections to accomplish the large model, but it may also be explained in one single construction manual that may be printed or otherwise communicated, e.g. by CD-ROM.

The invention also relates to a packaging for exercising the method. Thus, the method is intended for use in connection with a toy building set that comprises a number of different building elements that can be used for constructing a toy model by interconnecting the building elements. The effect described above is accomplished in that the packaging comprises means configured for separately enclosing such sets of building elements; that these building sets enable the construction of respective model sections of the toy model that can be accomplished by the interconnection of said model sections.

Typically the packaging comprises plastics bags or boxes for keeping the building elements apart in accordance with the invention.

The terms 'packaging' and 'the division of elements into sets of elements' are to be understood in the widest sense of the words. Thus, it is possible today to build a model of toy elements on a computer screen, where a number of building elements are available on the screen, following which one may, by means of the mouse, select a particular building element and arrange it on the model being built. This presupposes a construction manual as well as a selection of building elements on the screen. It is within the scope of the present invention to select an optimal range of building elements on the screen to enable the children to be, on the one hand, forced to choose the right element but, on the other hand, to spare the children to have to look through a very large number of elements.

BRIEF DESCRIPTION OF THE DRAWINGS

The invention will now be explained in further detail in the description that follows of a number of embodiments known from the well-known toy building sets marketed under the registered trade mark LEGO®, wherein.

DETAILED DESCRIPTION OF THE PREFERRED EMBODIMENT

Figure 1:
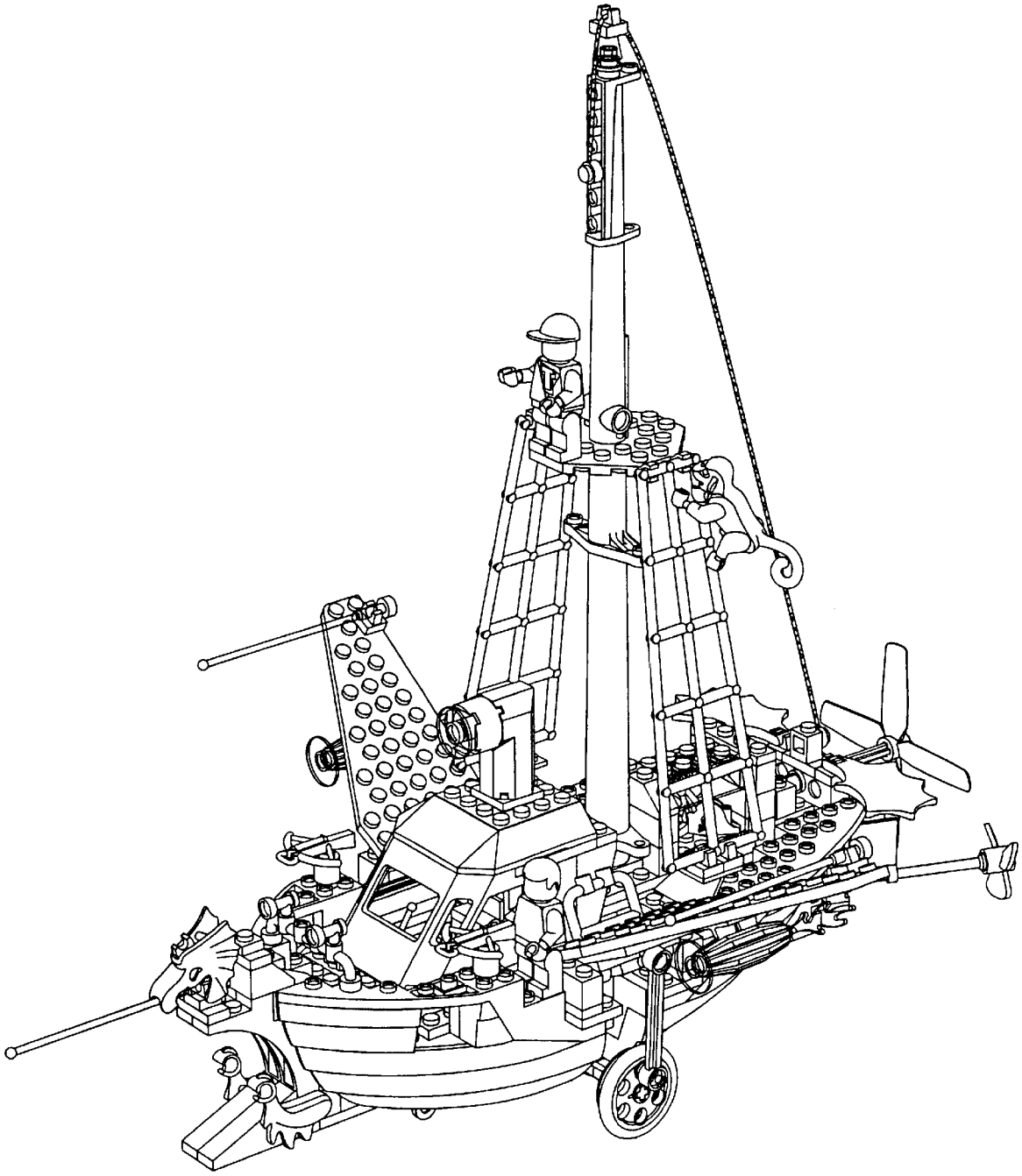
FIG. 1 shows a finished model.

FIG. 1 shows a model of a fantasy vessel that can be difficult to construct for small children. It is the object of the invention to allow that the targeted age can be lowered.

The building set can be sold in a usual manner in a box on the outside of which the model is typically depicted. In the box there is a number of compartments that may contain elements or may each contain one or more bags holding elements, cf. the description of the prior art given in the introductory part.

In accordance with the invention the contents of the different bags are matched with the construction manual whereby it is considerably more easy and expedient for the child to get an overall view of how the model is to be built.

Figure 2:
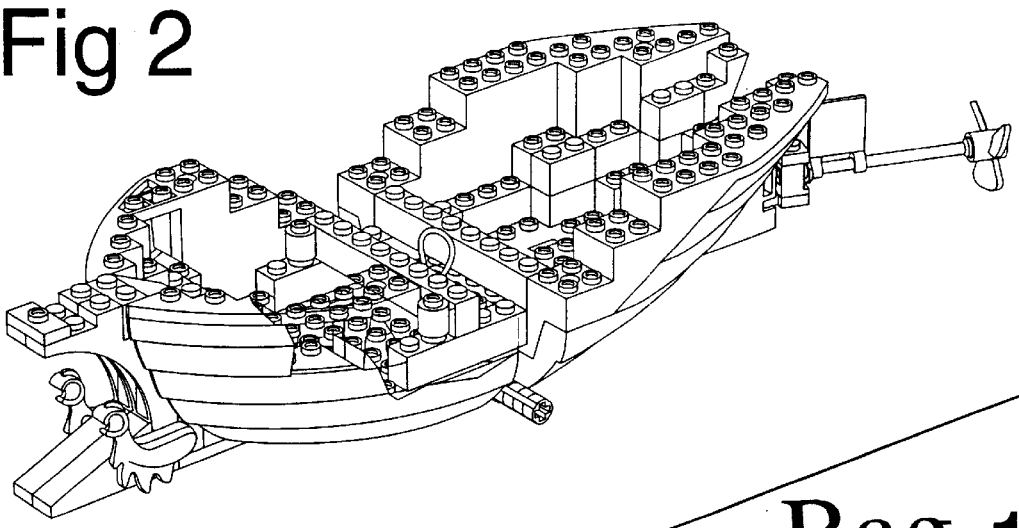
FIG. 2 shows a model section and the contents of a bag for building said section.
Figure 2:
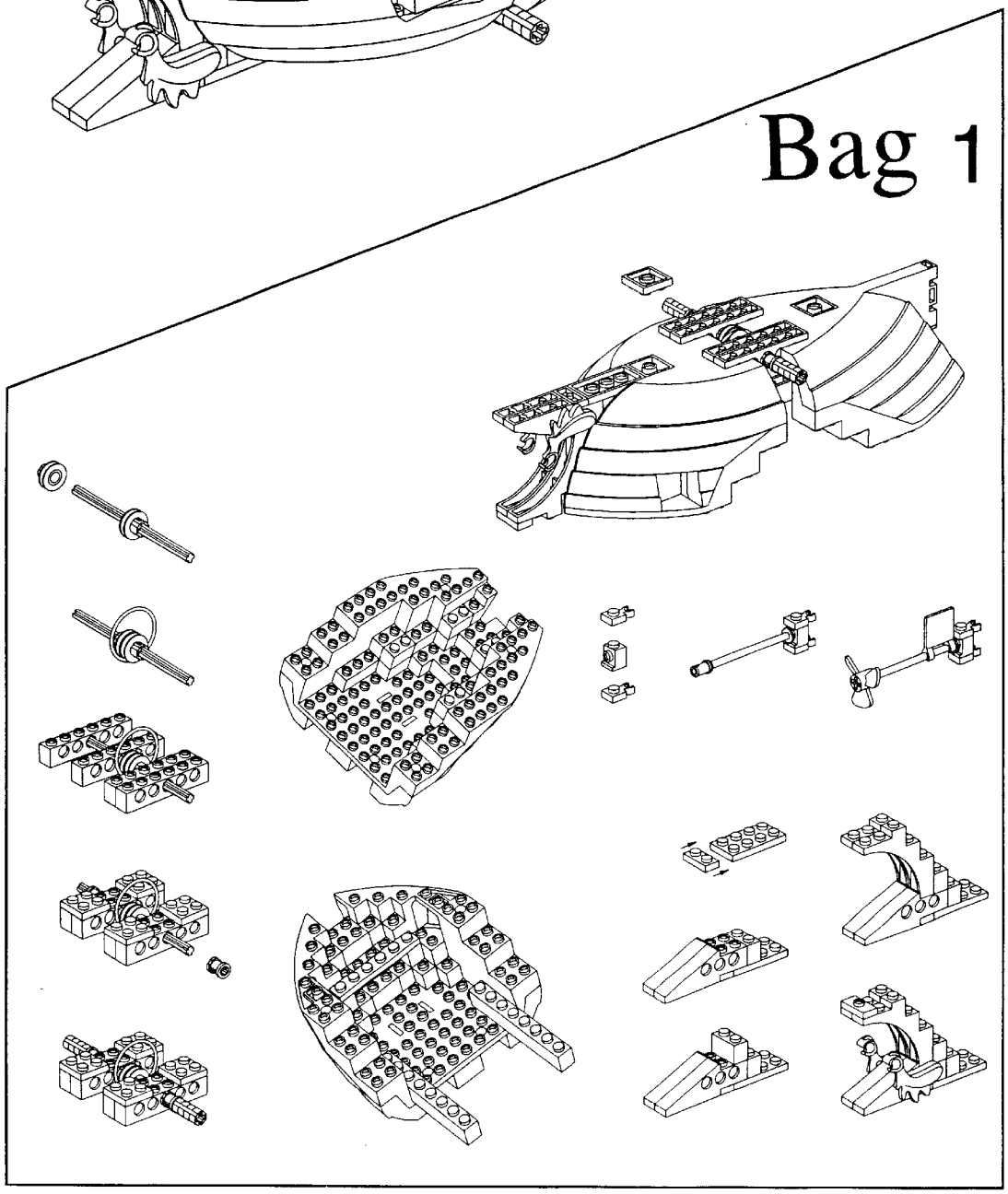

FIG. 2 illustrates a model section which can be built with the elements shown at the bottom of FIG. 2 and which can be contained in a first bag of building elements. A swift glance into the contents of bag 1, in combination with the construction manual, will readily reveal how the model section shown in FIG. 2 can be accomplished. The bag may be identified by means of numbers, letters, colours, pictures and the like.

Figure 3:
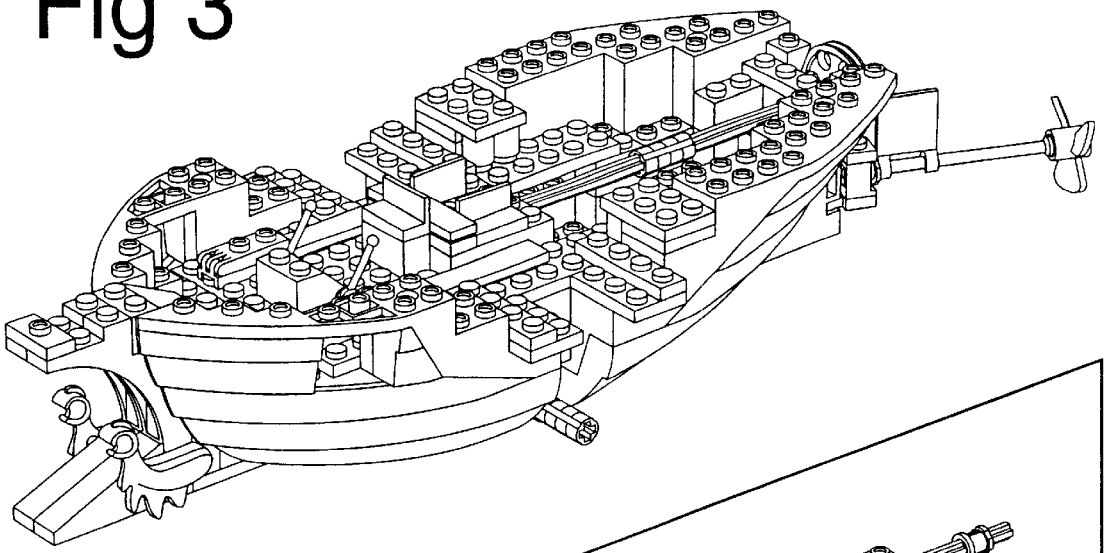
FIG. 3 shows the model which has been further enlarged by means of elements from the bag 2 shown in FIG. 3.
Figure 3:
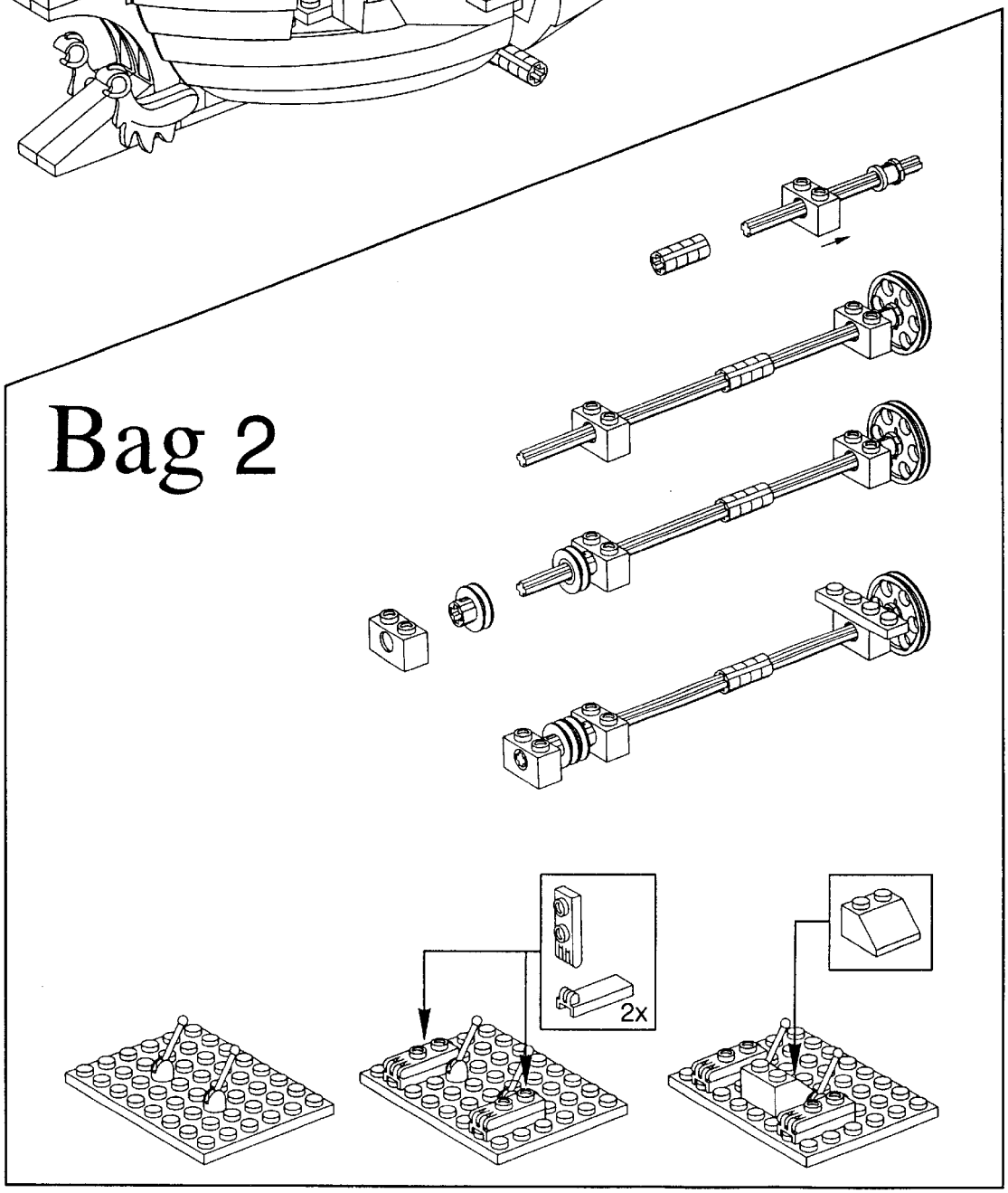

The model section of FIG. 2 can subsequently be enlarged to form the section shown in FIG. 3 by means of the elements contained in a bag labelled bag 2 and shown at the bottom of FIG. 3. By means of the accompanying construction manual it will appear where to position the elements of bag 2. It is to be noted that the elements that belong to bag 2 are not adequately shown in FIG. 3 that merely serves to impart the principle understanding of how a bag 2 will allow you to enlarge a relatively complex constituent model in a easy and well-planned manner.

By means of bag No 2 it is not possible to build a model portion in the form of a separate unit, since the contents of bag No 2 presuppose that the model section shown in FIG. 2 can be used as a starting point. The contents of bag No 2 enable building of a section but not a separate model portion.

Figure 4:
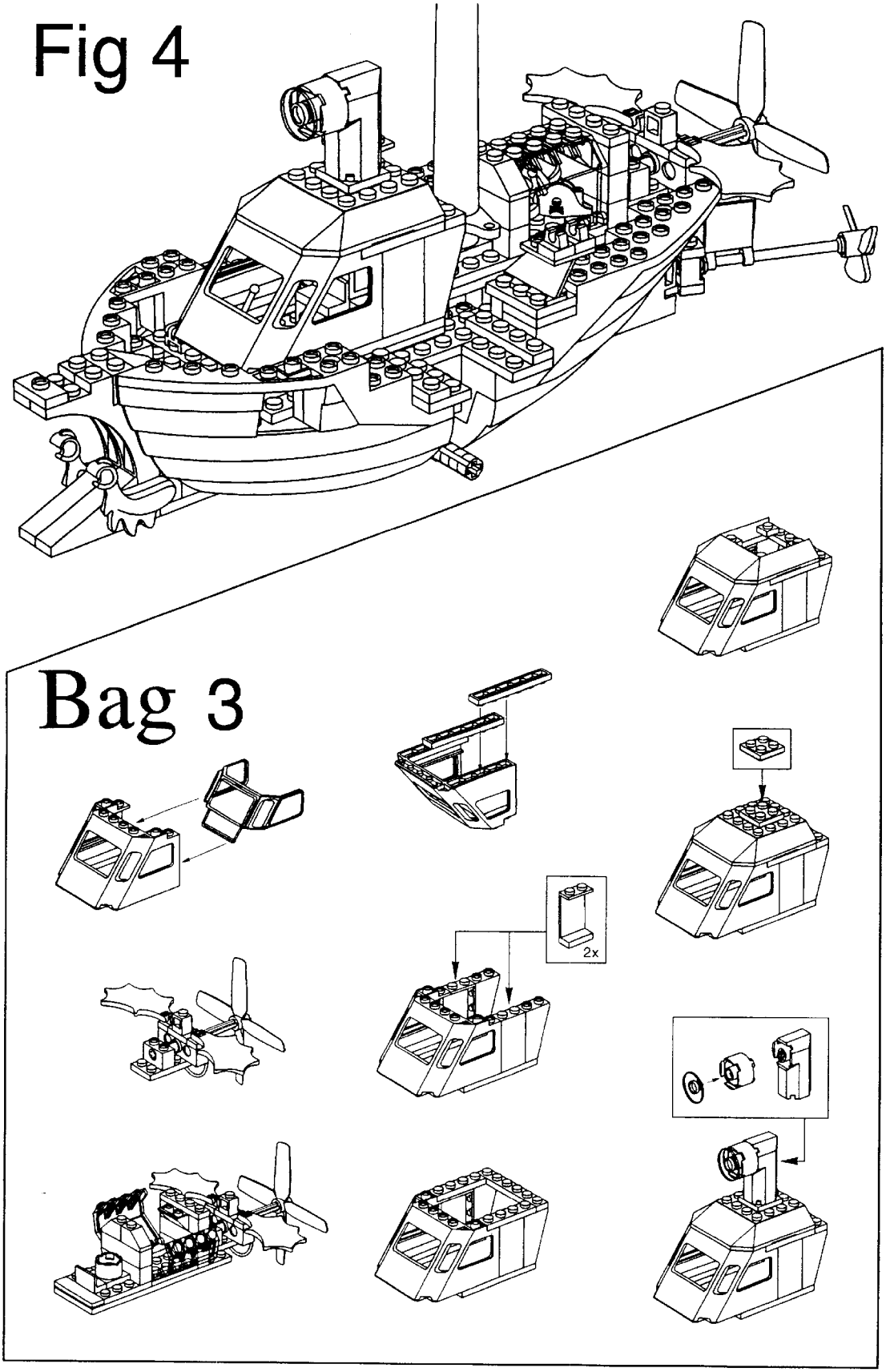
FIG. 4 shows the model which has been enlarged by means of the building elements contained in the bag 3 shown in FIG. 4.
Figure 5:
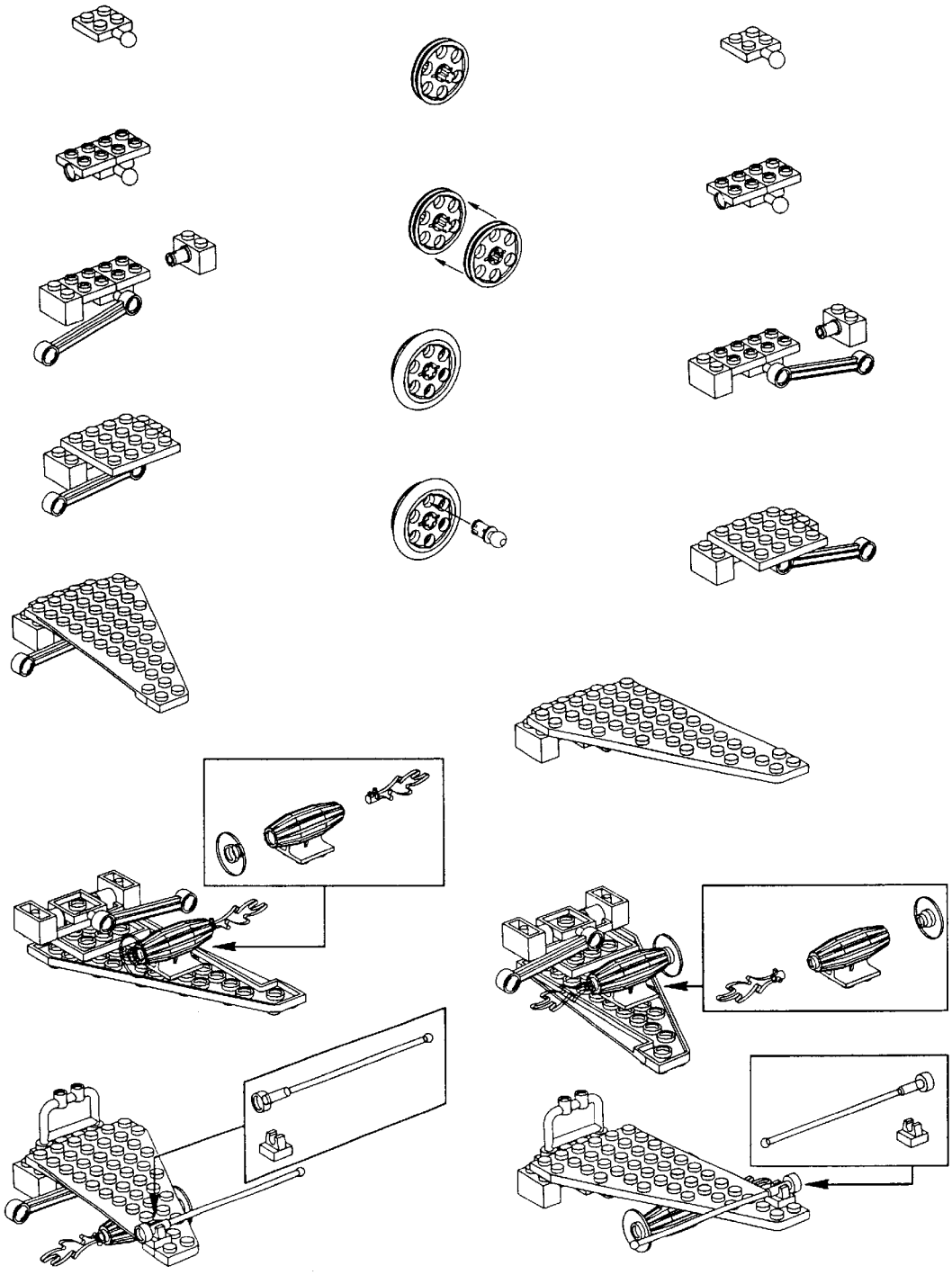
FIG. 5 shows the contents of a bag 4 used for completion of the model section shown in FIG. 4 to accomplish the finished model shown in FIG. 1.
Figure 6:
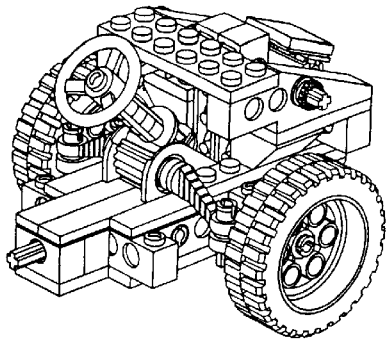
FIGS. 6–9 show model portions corresponding to a second embodiment.

This is not the case with the contents of bag No 3, the most important elements of which being shown in FIG. 4. On a shared building plate, a separate model portion can be built that comprises a steering box and a passenger cabin. This assembled model portion comprising steering box and passenger cabin can subsequently be mounted on the model portion shown in FIG. 3, and it that case bag No 3 is conveniently labelled with a picture of the steering box and the passenger cabin. Once the child has reached the result shown in FIG. 4, it can readily finish the model shown in FIG. 1 by means of the bag 4 shown in FIG. 5 (which, in practice, contains more elements than shown—typically figures and decorative elements).

Below, further embodiments will be described that provide, in addition to the above-mentioned advantages of the invention, further flexibility when a model is divided into a plurality of functional parts, each of which being packed in accordance with the invention.

Figure 8:
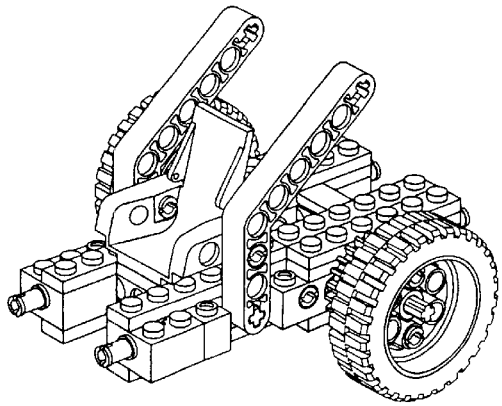
Figure 9:
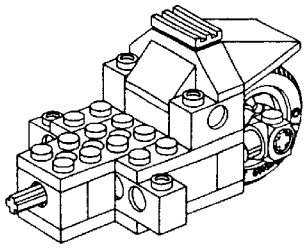

FIGS. 6, 7, 8, and 9 illustrate four different model portions having the following functions:

the front portion of a vehicle (FIG. 6), a motor (FIG. 7), the rear portion of a vehicle (FIG. 8), and an alternative front portion of a vehicle (FIG. 9).

Each of the model portions shown in FIGS. 6 through 9 can be built by means of elements that are packed in respective bags or separate boxes which are, in turns contained in the principal packaging of the toy building set. As described more detailed in connection with the first embodiment, construction manuals are included to shown how the model portions shown in FIGS. 6 through 9 are to be built. The separate bags or boxes are, as described previously, clearly labelled to match the construction manual thereby allowing the child to quickly identify the model portions as well as the associated individual elements.

Figure 10:
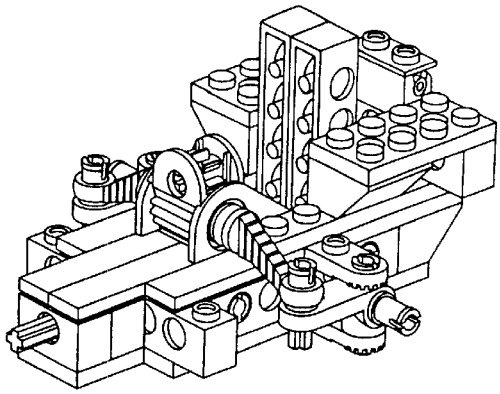
FIG. 10 shows a section of the model portion of FIG. 6.

Some of the model portion may—in order to further reduce the time consumed in searching for the elements—consist of a plurality of sections. FIG. 10 illustrates how a subsection of model portion 6 may look, and in correspondence with the previous explanation, the elements belonging to the subsection shown in FIG. 10 can be packed in a separate bag or box, and likewise the remaining elements for finishing the model portion shown in FIG. 6 can be delivered in it respective bag or box.

The time saved and the flexibility are further enhanced in that the model portions are divided as to functionality, as will be subject to more detailed explanation with reference to the following figures.

Figure 7:
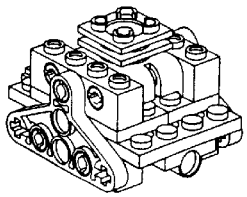
Figure 11:
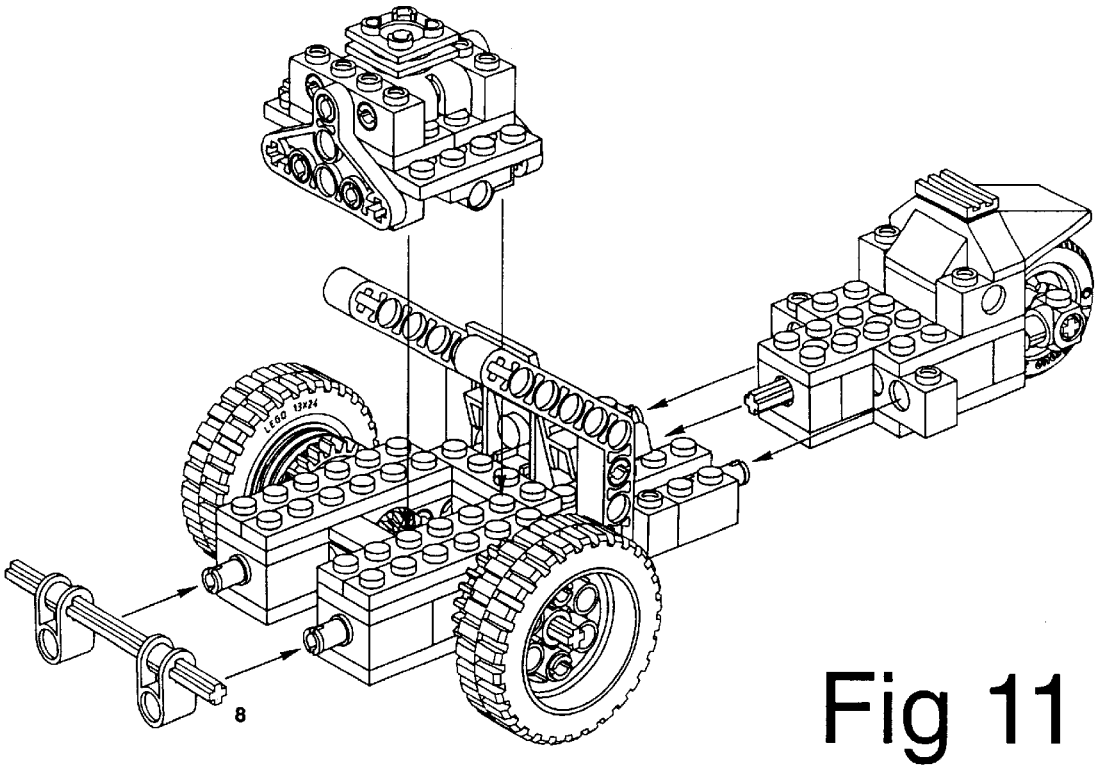
FIGS. 11 and 12 illustrate a first use of the model portions shown in FIGS. 6–9.
Figure 12:
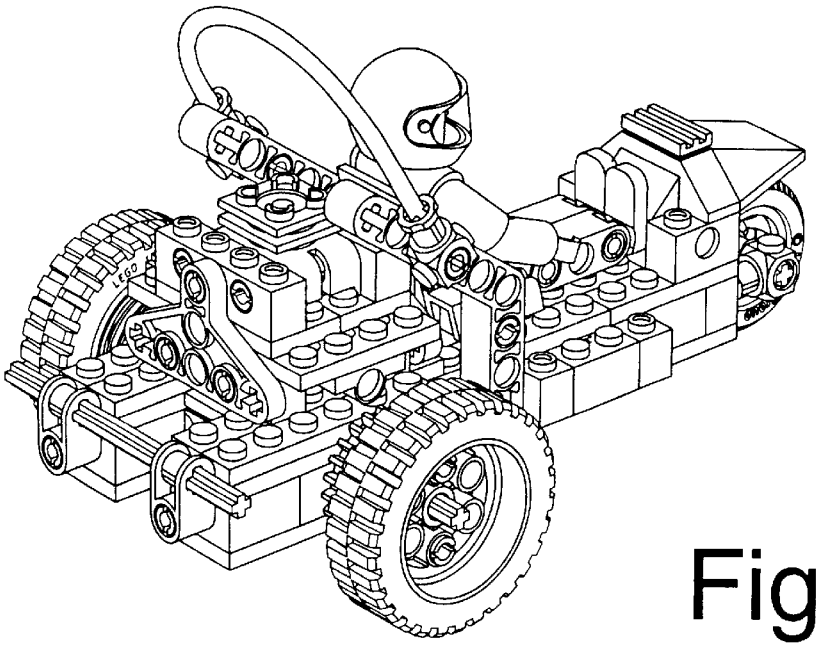

FIG. 11 is a typical example of a picture from a construction manual and which shows how, by combining the model portions from FIGS. 7, 8, and 9, the child is able to assemble the model shown in FIG. 12 in a quick manner and without difficulty.

Figure 13:
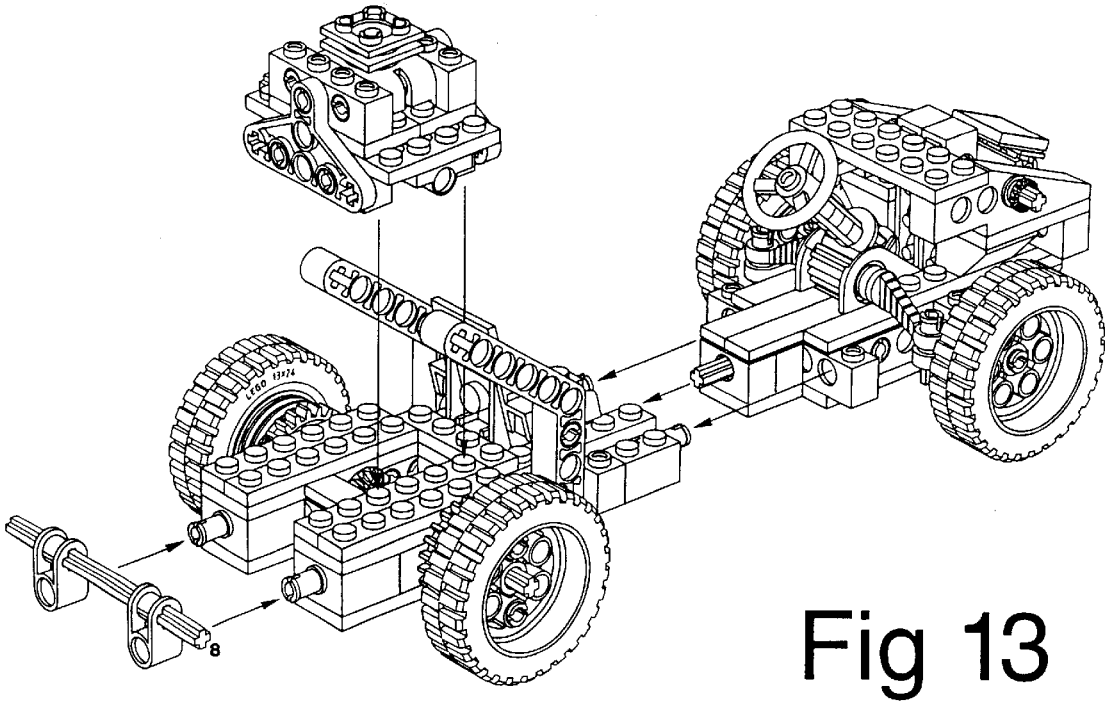
FIGS. 13 and 14 illustrate a second use of the model portions shown in FIGS. 6–9.
Figure 14:
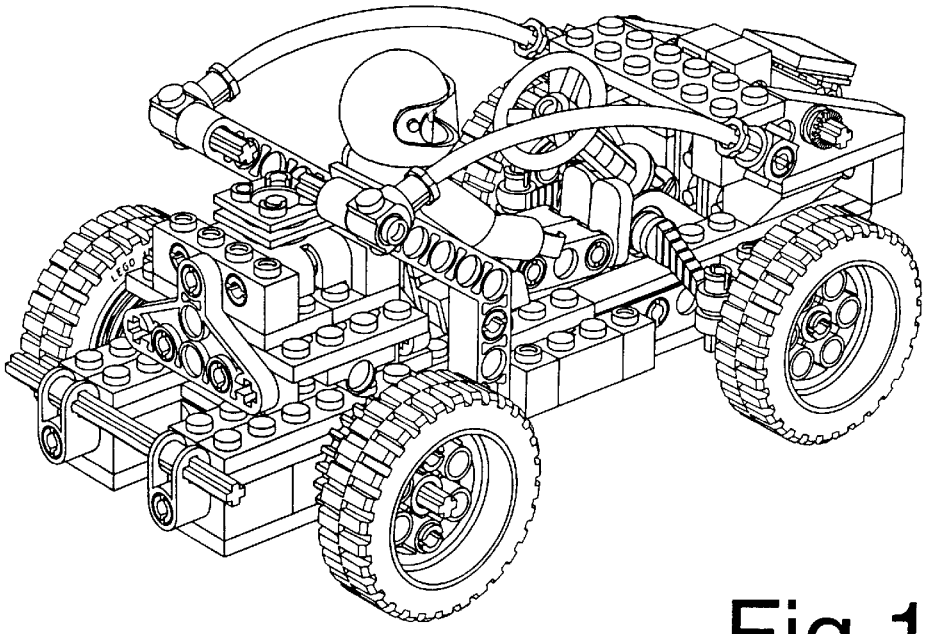

FIG. 13 that can also be comprised in a construction manual shows how the child can use the model portions 6, 7 and 8 to assemble the model shown in FIG. 14.

Figure 15:
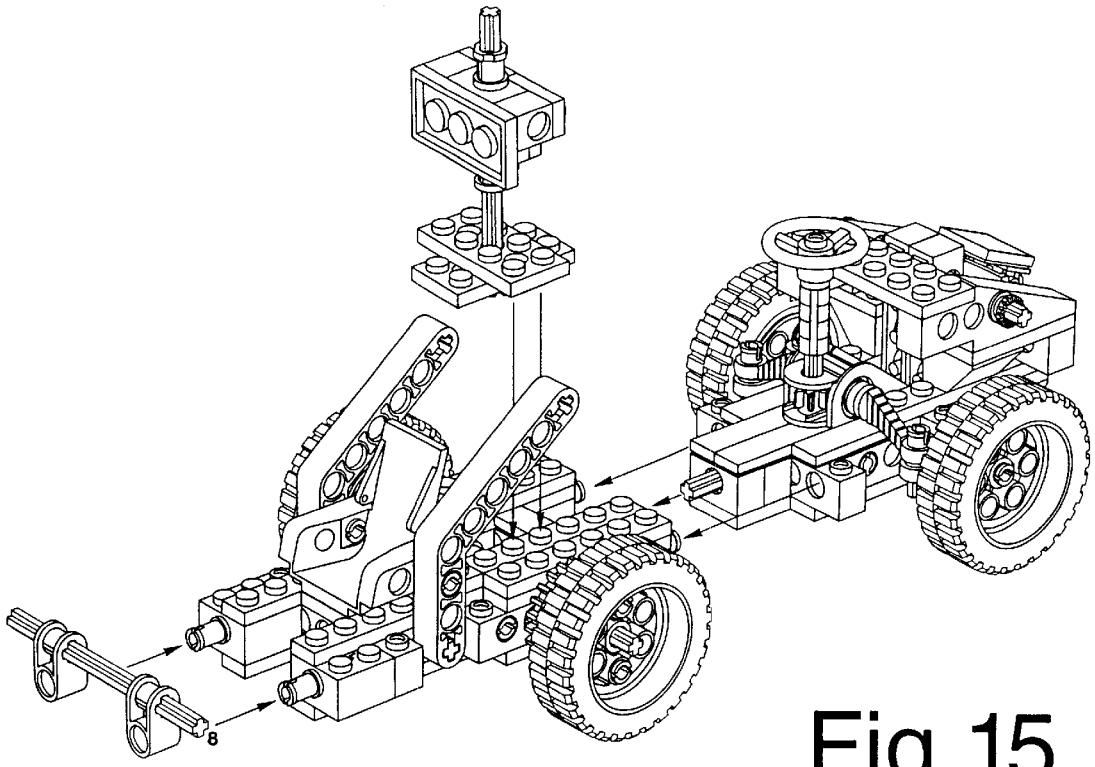
FIGS. 15 and 16 illustrate a third use of the model portions shown in FIGS. 6–9.
Figure 16:
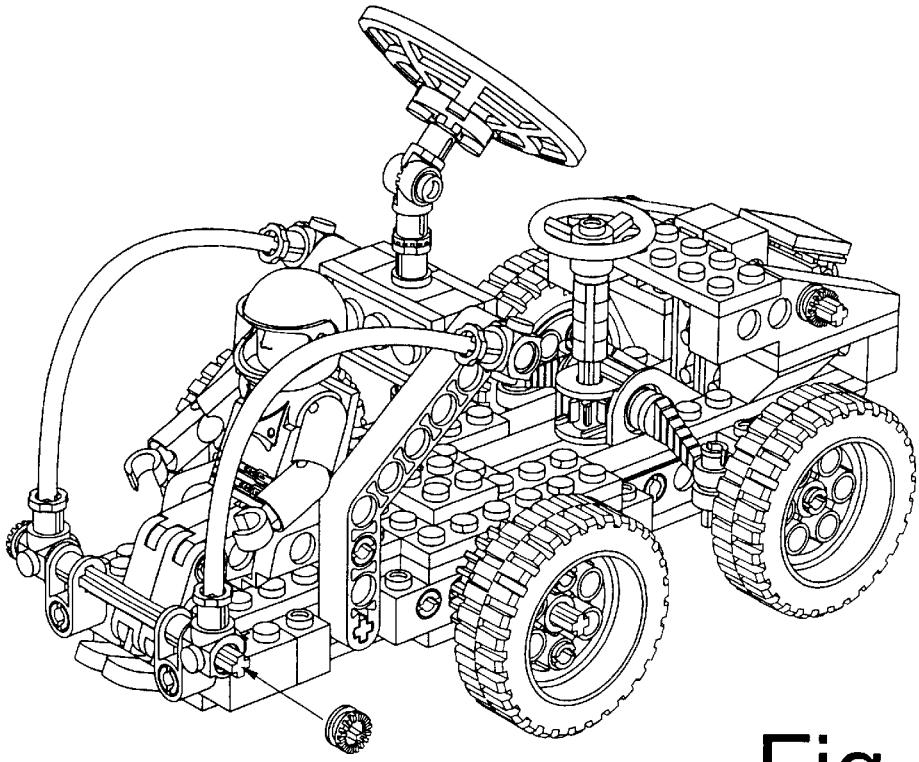

FIG. 15 can be part of the construction manual and shows how, simply by turning the model portion 8 upside down and adding a few further elements, the child is able to modify the vehicle shown in FIG. 14 into the vehicle shown in FIG. 16.

Figure 17:
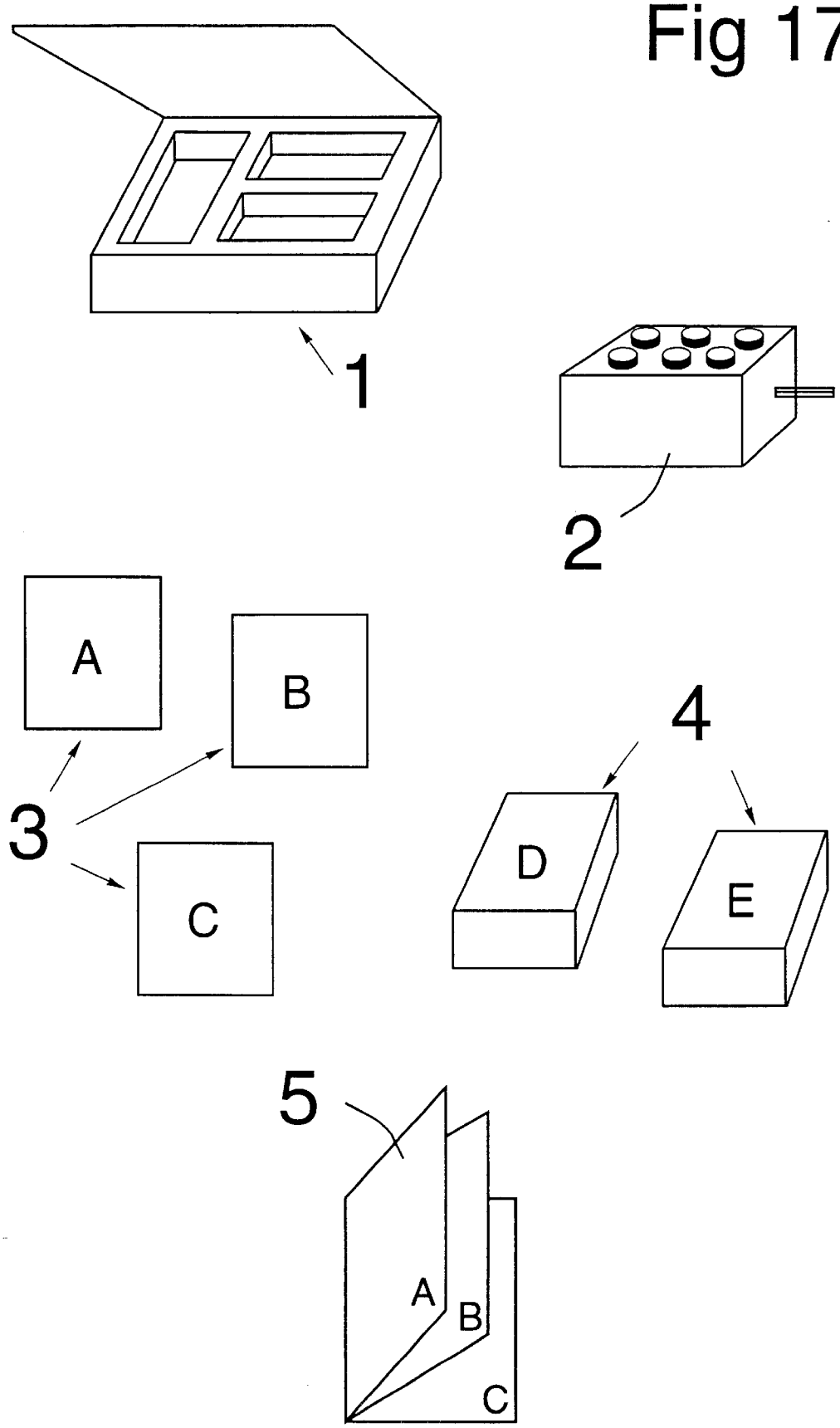
FIG. 17 shows a packaging according to the invention.

FIG. 17 is an example of a packaging according to the invention. The packaging consists of portions that are known per se, viz a box 1 with a lid and a number of compartments for containing the building elements. The compartments can be divided to contain separate large elements, eg a motor 2 or bags 3 or boxes 4 with toy building elements. Furthermore, one or more construction manuals are present, shown e.g. in the form of a booklet, but it could also be a CD-ROM.

According to the invention the bags 3 and/or the boxes 4 or the like are provided with a clear indication, e.g. with letters A–E and/or depictions that clearly identify the corresponding model portions, optionally model sections in correspondence with the construction manual.

What is claimed is:

1. A method of packaging toy building elements for the construction of a toy model, said method comprising the steps of:

packaging a first plurality of building elements into a first packaging set with at least two of said building elements of said first plurality discrete from each other, said building elements of said first plurality capable of interconnecting with one another to form at least a first specific model section;

packaging a second plurality of building elements into a second packaging set with a least two of said building elements of said second plurality discrete from each other, said building elements of said second plurality capable of interconnecting with one another to form at least a second specific model section;

arranging a plurality of packaging sets, including at least said first and second packaging sets in a toy building set; and providing a construction explanation wit said toy building set, said construction explanation identifying said first model section as being interconnectable with said second model section, such that interconnecting a plurality of model sections, including at least said first and second model sections, constructs said toy model.

2. The method in accordance with claim 1 wherein said construction explanation identifies said model section interconnection by a visual order.

3. The method in accordance with claim 1 wherein said construction explanation identifies said model section interconnection by a sequential order.

4. The method in accordance with claim 1 wherein said construction explanation includes a construction manual.

5. The method in accordance with claim 1 wherein said construction explanation further includes a construction manual particular to each packaging set of said plurality of packaging sets.

6. The method in accordance with claim 1 wherein packaging sets of said plurality of packaging sets are contained in bags such that said packaging sets of said plurality of packaging sets are separate from each other.

7. The method in accordance with claim 1, wherein said packaging sets of said plurality of packaging sets are contained in boxes such that said packaging sets of said plurality of packaging sets are separate from each other.

* * * * *